US008517781B1

(12) United States Patent
Mariansky

(10) Patent No.: US 8,517,781 B1
(45) Date of Patent: Aug. 27, 2013

(54) APPARATUS FOR PROPELLING A DIVER IN WATER

(71) Applicant: Reynaldo Mariansky, Sacramento, CA (US)

(72) Inventor: Reynaldo Mariansky, Sacramento, CA (US)

( * ) Notice: Subject to any disclaimer, the term of this patent is extended or adjusted under 35 U.S.C. 154(b) by 0 days.

(21) Appl. No.: 13/647,932

(22) Filed: Oct. 9, 2012

(51) Int. Cl.
*B63H 16/08* (2006.01)

(52) U.S. Cl.
USPC ..... 440/24; 114/315

(58) Field of Classification Search
USPC ..... 114/315; 440/13, 14, 15, 17, 20, 440/21, 24, 25, 26
See application file for complete search history.

(56) References Cited

U.S. PATENT DOCUMENTS

| | | | | | |
|---|---|---|---|---|---|
| 468,989 | A | * | 2/1892 | Mallet | 440/24 |
| 693,615 | A | * | 2/1902 | Minkus | 440/24 |
| 3,349,746 | A | * | 10/1967 | Sydoriak | 440/24 |
| 3,505,970 | A | * | 4/1970 | Sydoriak | 440/24 |
| 3,918,388 | A | * | 11/1975 | Bernard | 440/24 |
| 3,995,578 | A | * | 12/1976 | McCullough | 114/315 |
| 4,158,245 | A | * | 6/1979 | Cunningham | 440/24 |

* cited by examiner

*Primary Examiner* — Lars A Olson
(74) *Attorney, Agent, or Firm* — Thomas R. Lampe

(57) ABSTRACT

Apparatus for propelling a diver in water includes propulsion blades positioned behind the diver and blade actuators operable to move the blades to propel the diver through use of the diver's leg movements.

11 Claims, 5 Drawing Sheets

APPARATUS FOR PROPELLING A DIVER IN WATER

TECHNICAL FIELD

This invention relates to apparatus to be worn by a diver and used to propel a diver in water. The apparatus is also operable to change direction of movement of the diver.

BACKGROUND OF THE INVENTION

Both scuba divers and non-scuba divers often utilize fins attached to their feet to propel them in the water. This mode of transport is inefficient and causes diver fatigue. It is also known to utilize independently powered devices, typically utilizing propellers, to transport a diver under water.

DISCLOSURE OF INVENTION

The present invention relates to apparatus for propelling a diver in water which does not utilize either fins or independently powered devices to move a diver through the water. The apparatus is utilized using leg power, but in a manner that is much less fatiguing and considerably more efficient than employing fins. With the apparatus of this invention a diver can easily change direction of movement in the water. When utilizing this invention, the diver has both hands free.

The subject apparatus for propelling a diver in water includes a first propulsion blade and a second propulsion blade.

Attachment structure is provided for releasably attaching the apparatus to a diver with the first and second propulsion blades positioned behind the diver.

A first blade actuator is operatively associated with the first propulsion blade and extendable toward a diver's foot.

A second blade actuator is operatively associated with the second propulsion blade and extendable toward the diver's other foot.

Actuator connector structure is provided for connecting the first and second blade actuators at or closely adjacent to their respective associated diver's foot. The first and second blade actuators are operable responsive to movement of the diver's legs to independently move their associated propulsion blades to propel and selectively change direction of movement of the diver.

Other features, advantages and objects of the present invention will become apparent with reference to the following description and accompanying drawings.

BEST MODE FOR CARRYING OUT THE INVENTION

Figure 1:
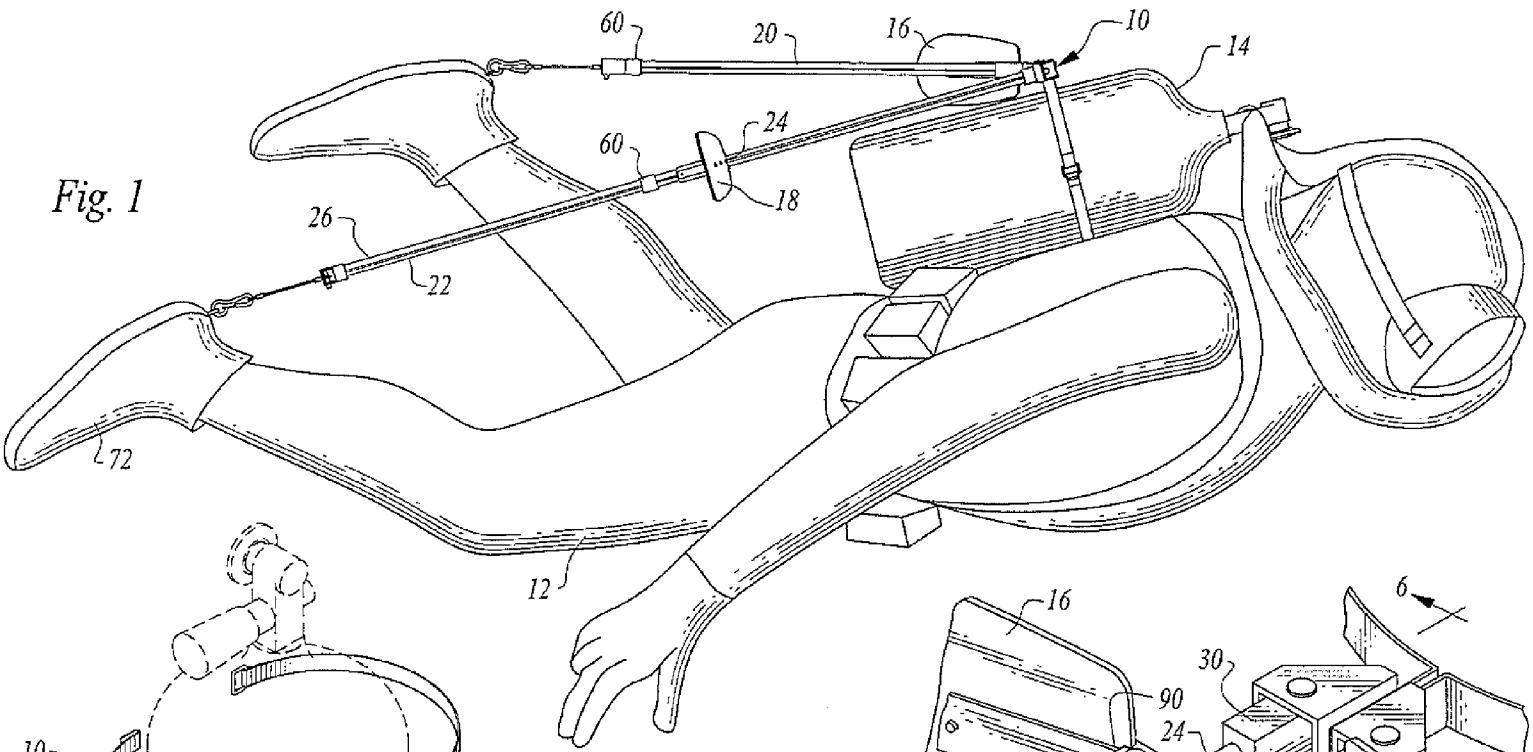
FIG. 1 is a perspective view showing apparatus constructed in accordance with the teachings of the present invention connected to a diver and utilized to propel the diver in water.
Figure 9:
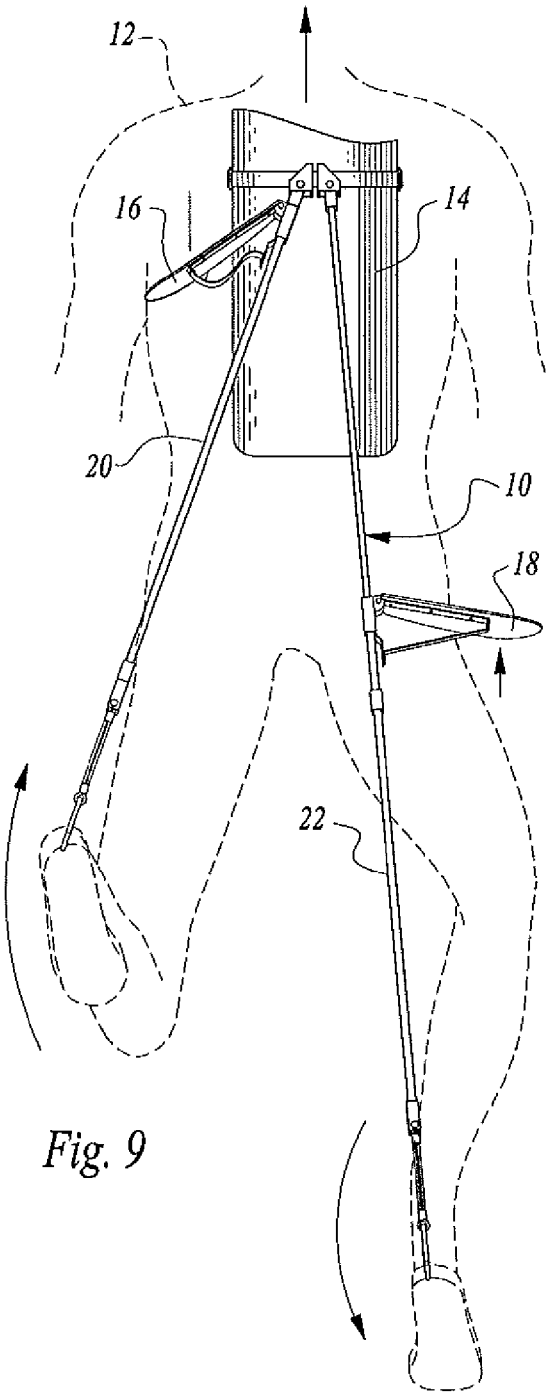
FIGS. 9 and 10 are top plan views of the apparatus on the back of a diver illustrating alternate use of the propulsion blades of the apparatus to propel the diver.
Figure 10:
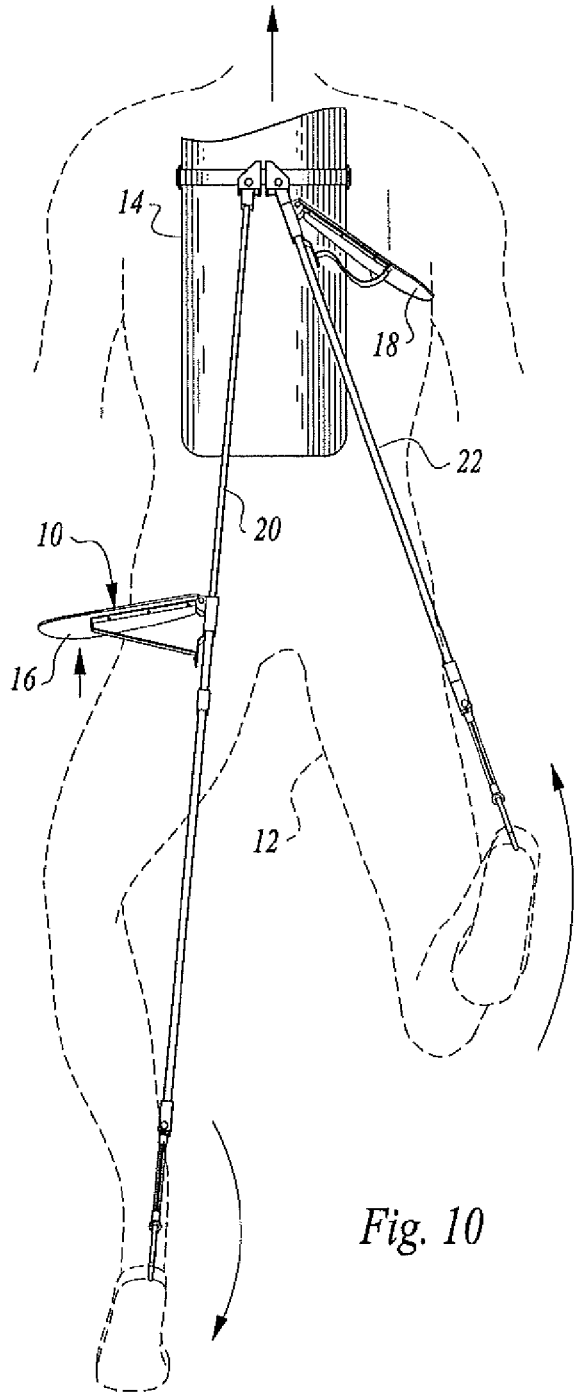

Referring now to the drawings, apparatus constructed in accordance with the teachings of the present invention is designated by reference numeral 10. FIGS. 1, 9 and 10 show the apparatus releasably attached to a diver 12 in water. More particularly, the apparatus is located behind the diver's back, in this instance attached to a scuba tank 14 located on the diver's back. The principles of the present invention are, however, applicable to more direct connection to the diver, such as by employing a strap or harness secured to the diver's body.

The apparatus includes two propulsion blades 16, 18. A blade actuator 20 is operatively associated with the propulsion blade 16 and extendable toward one of the diver's feet. A blade actuator 22 is operatively associated with the propulsion blade 18 and extendable toward the other of the diver's feet.

The blade actuators 20, 22 are essentially identical in construction and each includes a telescopic structure having an elongated proximal telescopic member 24 and an elongated distal telescopic member 26, the elongated distal telescopic member slidably movable relative to the elongated proximal telescopic member.

Figure 11:
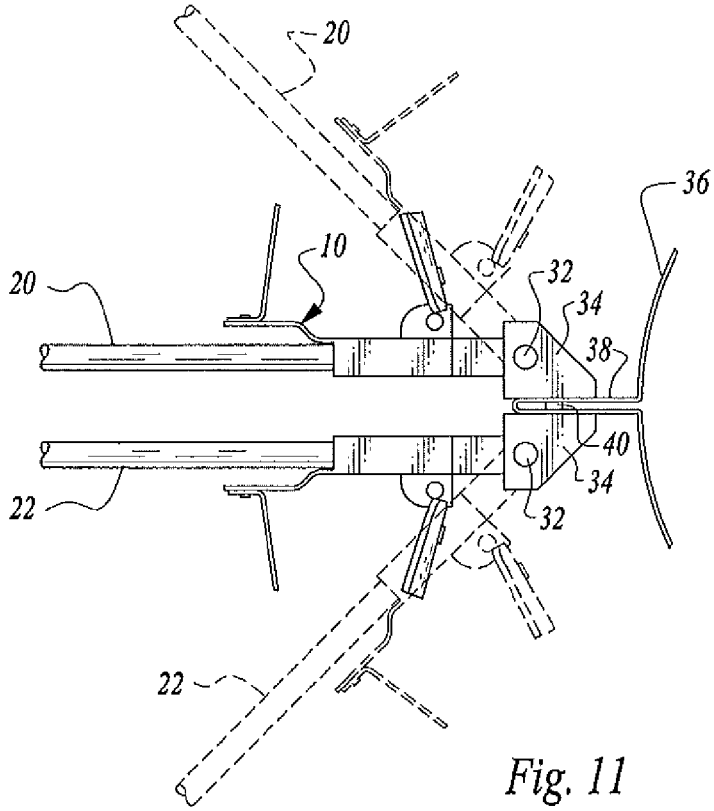
FIG. 11 is a top, plan view illustrating portions of the blade actuators pivotally attached to a securement strap and positioning of the blade actuators and associated propulsion blades in two alternate positions, one indicated by solid lines and the other by dash lines.
Figure 12:
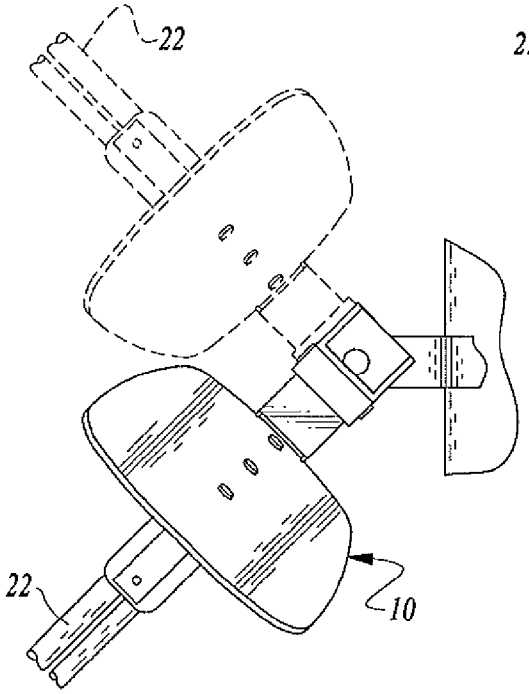
FIG. 12 is a side elevation view showing by use of solid and dash lines two alternative positions of a portion of a blade actuator and associated propulsion blade about a pivot.

In the illustrated arrangement, the proximal telescopic member 24 includes a tube 28 having an end thereof secured to an end piece 30. The end piece 30 is pivotally connected by a pivot pin 32 to a bracket 34 which is secured to a strap 36 disposed about and in tight engagement with scuba tank 14. Any suitable means may be employed to provide such attachment. As may be seen with reference to FIG. 11, for example, such pivoted interconnection enables the blade actuators 20, 22 to be moved between a position shown in solid lines wherein the blade actuators extend generally parallel to the longitudinal axis of the diver's body to an inclined position (such as that illustrated in FIG. 11 in dash lines) wherein the blade actuators are inclined relative to the longitudinal axis of the diver's body. In addition, the end pieces 30 are attached to a projection 38 of the strap by means of a pivot pin 40 (see FIG. 11). Thus, the blade actuators 20, 22 can be pivoted in a plane of motion pivotally at right angles to the plane of motion shown in FIG. 11 about pivot pins 32.

Figure 5:
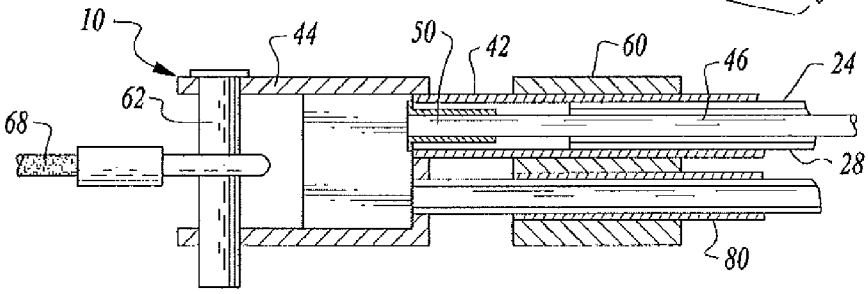
FIG. 5 is a greatly enlarged, cross-sectional view taken along the line 5-5 of FIG. 4.
Figure 6:
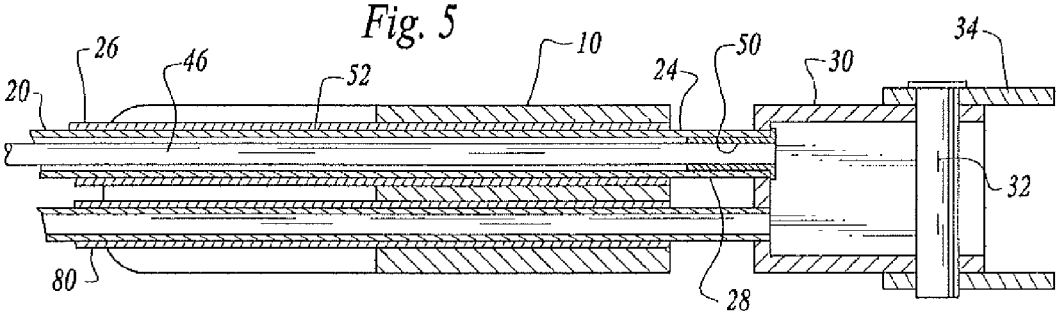
FIG. 6 is a greatly enlarged, cross-sectional view taken along line 6-6 of FIG. 3.
Figure 8:
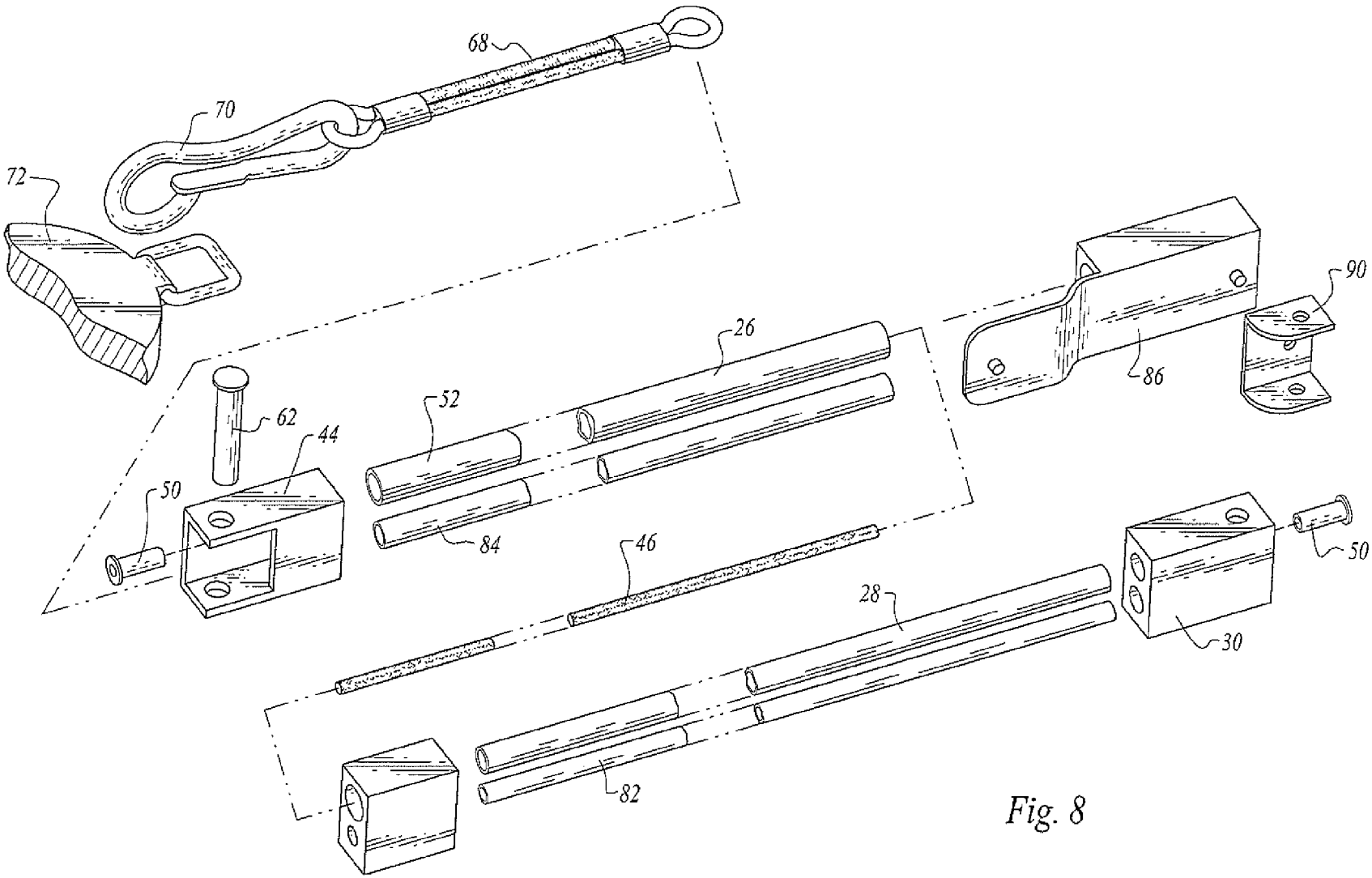
FIG. 8 is an enlarged, exploded view illustrating in perspective the constituent structural elements of one of the two blade actuators of the apparatus prior to assembly.

The tube 28 of the proximal telescopic member 24 extends away from bracket 34 toward a connector bracket 44 (see FIG. 5, for example) and terminates (see FIG. 5) within a tubular member 42 secured to connector bracket 44. A stabilizer/connector rod 46 extends between end piece 30 and connector bracket 44, being connected thereto by mechanical fasteners 50.

Figure 3:
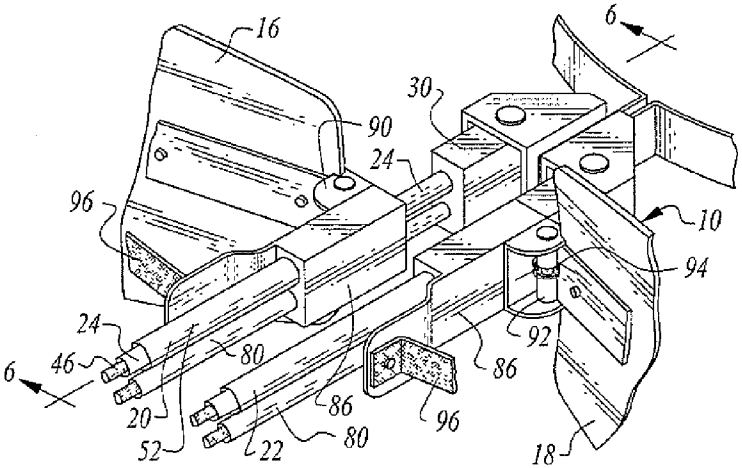
FIG. 3 is an enlarged, perspective view illustrating a section of a securement strap and adjacent portions of other structural elements of the apparatus attached thereto.
Figure 2:
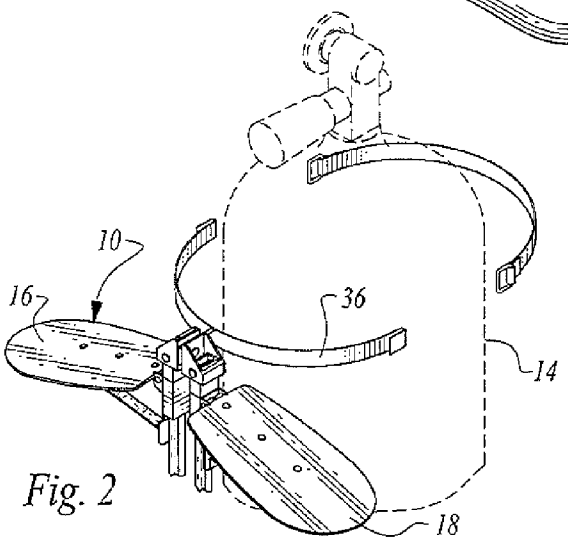
FIG. 2 is a perspective view illustrating a portion of the apparatus prior to attachment thereof to a scuba tank, the latter being illustrated in dash lines.
Figure 4:
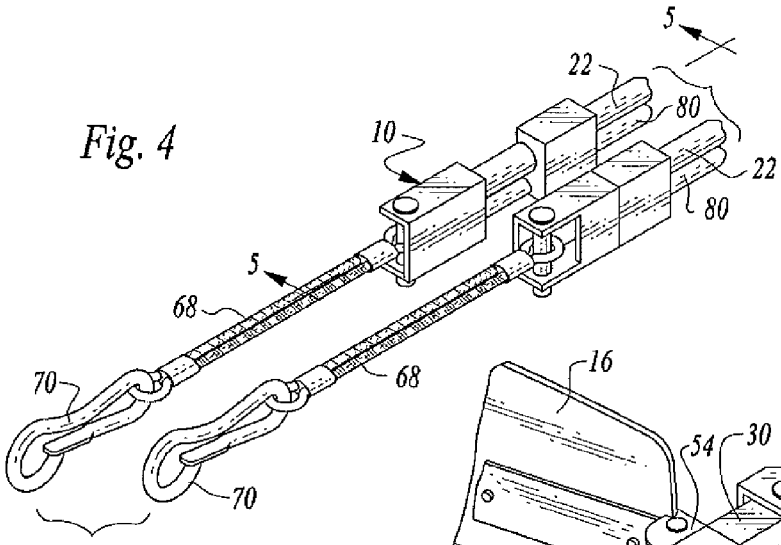
FIG. 4 is an enlarged, perspective view showing propulsion blade portions and portions of blade actuator structure of the apparatus and flexible blade movement restraints attached thereto.
Figure 7:
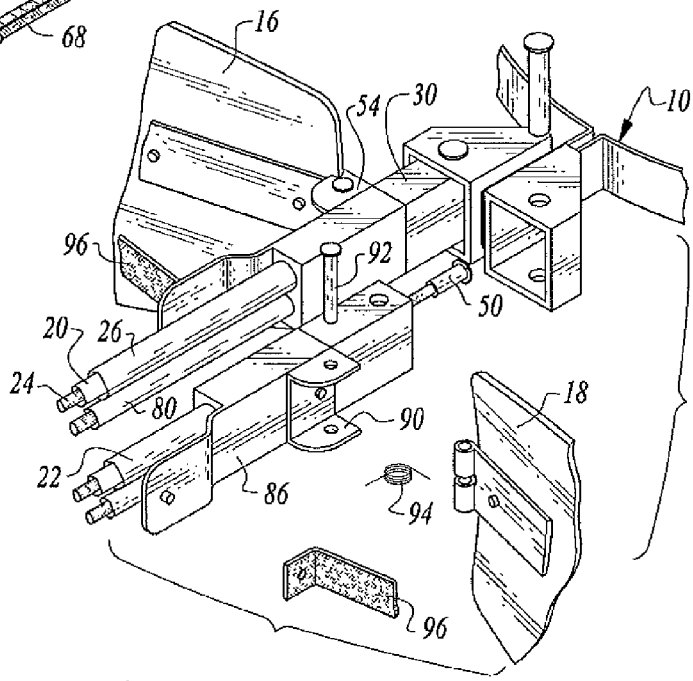
FIG. 7 is an enlarged, perspective view illustrating selected portions of the apparatus relating to the propulsion blades and associated structure and illustrating one blade and associated structure fully assembled and a second blade and associated structure disassembled.
Figure 13:
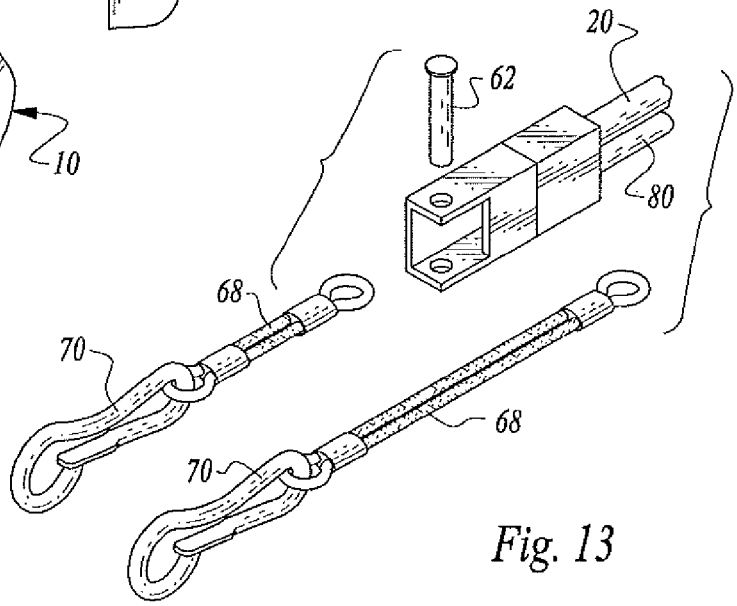
FIG. 13 is an enlarged, perspective, exploded view illustrating one flexible connector of the apparatus in non-stretched condition and the other in stretched condition, the distal end of a blade actuator for receiving and being connected to the unstretched flexible connector also being shown.

Distal telescopic member 26 includes a tubular member 52 which is disposed about tube 28 and rod 46 of the proximal telescopic member 24 and is axially slidable relative thereto. At the end thereof adjacent to end piece 30, the tubular member 52 is affixed to a block member 54 and slidable therewith relative to the proximal telescopic member. The block member 54 is movable between a position shown in FIG. 7 wherein end piece 30 is engaged (see FIGS. 3 and 7) to locations away from the end piece. At the other end thereof the tubular member 42 has a block member 60 disposed thereabout and fixedly secured thereto, the block member 60 shown in FIG. 5 in a position wherein it does not engage connector bracket 44 and shown in a position in FIG. 13 wherein it is not separated therefrom.

A connector pin 62 is employed to releasably connect the connector bracket 44 to a flexible connector 68 formed of stretchable material having an elastic memory. In the arrangement illustrated, the flexible connector 68 is attached by clips 70 to the heels of shoes 72 worn by the diver.

In the arrangement illustrated, to provide additional stability and effectiveness, the blade actuators include a second telescopic structure in addition to that described above. This second telescopic structure is identified by reference numeral 80 and includes a proximal telescopic member 82 and a distal telescopic member 84.

Propulsion blade 16 and propulsion blade 18 are pivotally mounted on a blade support 86 which are attached to the elongated distal telescopic members 26, 84. The propulsion blades are pivotally connected to a blade support bracket 90 of the blade support 86 by pivot pins 92. Coil springs 94 continuously urge the propulsion blades to the previously described position wherein the blades extend generally orthogonal to the primary axis of the elongated distal telescopic member associated therewith, that is, to their outwardly extended positions.

Blade movement restraints in the form of flexible straps 96 connecting the propulsion blades to the elongated distal telescopic members prevent the blades from moving upwardly beyond their most efficient outwardly extending positions.

FIGS. 9 and 10 illustrate the apparatus in use to propel a diver in a forward direction. By modifying the positioning of the blade actuators during use the diver can readily change and control his or her direction of movement.

The invention claimed is:

1. Apparatus for propelling a diver in water, said apparatus comprising, in combination:

a first propulsion blade;

a second propulsion blade;

attachment structure for releasably attaching the apparatus to a diver with said first and second propulsion blades positioned behind the diver;

a first blade actuator operatively associated with said first propulsion blade and extendable toward a diver's foot;

a second blade actuator operatively associated with said second propulsion blade and extendable toward the diver's other foot; and actuator connector structure for connecting said first and second blade actuators at or closely adjacent to their respective associated diver's foot, said first and second blade actuators being operable responsive to movement of the diver's legs to independently move their associated propulsion blades to propel and selectively change direction of movement of the diver.

2. The apparatus according to claim 1 wherein each of said first and second blade actuators includes a telescopic structure having an elongated proximal telescopic member adjacent to the attachment structure and an elongated distal telescopic member, said elongated distal telescopic member slidably movable relative to said elongated proximal telescopic member.

3. The apparatus according to claim 2 wherein said first propulsion blade is connected to and movable with the elongated distal telescopic member of said first blade actuator and wherein said second propulsion blade is connected to and movable with the elongated distal telescopic member of said second blade actuator.

4. The apparatus according to claim 3 wherein said first propulsion blade is pivotally connected to the elongated distal telescopic member of said first blade actuator and pivotally movable between an outwardly extended position wherein the first propulsion blade extends generally orthogonal to the primary axis of the elongated distal telescopic member of the first blade actuator and an inclined position wherein the first propulsion blade does not extend generally orthogonal to the primary axis of the elongated distal telescopic member of the first blade actuator, and wherein said second propulsion blade is pivotally connected to the elongated distal telescopic member of said second blade actuator and pivotally movable between an outwardly extended position wherein the second propulsion blade extends generally orthogonal to the primary axis of the elongated distal telescopic member of the second blade actuator and an inclined position wherein said second propulsion blade does not extend generally orthogonal to the primary axis of the elongated distal telescopic member of the second blade actuator.

5. The apparatus according to claim 4 additionally including springs operatively associated with said first and second propulsion blades biasing said first and second propulsion blades toward their outwardly extended positions.

6. The apparatus according to claim 1 wherein said attachment structure includes securement structure for releasably securing the apparatus behind the diver and pivot structure connected to the securement structure pivotally attaching the proximal telescopic members of the first and second blade actuators to said securement structure.

7. The apparatus according to claim 6 wherein said pivot structure incorporates pivots enabling each of said first and second blade actuators to pivot independently of one another about said pivot structure in two generally perpendicular planes of motion.

8. The apparatus according to claim 3 additionally comprising propulsion blade movement restraints attached to said propulsion blades for maintaining said propulsion blades generally orthogonal to the primary axis of their respective associated elongated distal telescopic member during propulsion caused by the propulsion blades.

9. The apparatus according to claim 8 wherein said blade movement restraints comprise flexible straps connecting said propulsion blades to the elongated distal telescopic members.

10. The apparatus according to claim 2 wherein said first and second blade actuators each additionally include a flexible connector extending from the elongated distal telescopic members thereof for releasable connection to shoes or other outerwear of the diver.

11. The apparatus according to claim 10 wherein said flexible connector is formed of stretchable material having an elastic memory.

* * * * *